US005810067A

United States Patent [19]

Atari et al.

[11] Patent Number: 5,810,067

[45] Date of Patent: Sep. 22, 1998

[54] METHOD AND APPARATUS FOR MOLDING A LIGHT-ALLOY WHEEL

[75] Inventors: Masayuki Atari, Toyokawa; Yasuyuki Murata, Toyohashi; Shun Yamada, Minamishitara-gun; Yuichi Suzuki, Toyohashi; Kishiro Abe, Ayase; Hisashi Yoshimura, Kitakyushu; Akira Ishida, Toyohashi, all of Japan

[73] Assignee: Topy Kogyo Kabushiki Kaisha, Japan

[21] Appl. No.: 780,283

[22] Filed: Jan. 8, 1997

[30] Foreign Application Priority Data

| | | | |
|---|---|---|---|
| Jan. 12, 1996 | [JP] | Japan | 8-003866 |
| Mar. 18, 1996 | [JP] | Japan | 8-060495 |
| Jun. 18, 1996 | [JP] | Japan | 8-157072 |

[51] Int. Cl.[6] ..... B22C 9/28; B22D 29/00; B22D 33/04

[52] U.S. Cl. ..... 164/120; 164/132; 164/137; 164/340; 164/342; 249/56

[58] Field of Search ..... 164/120, 132, 164/137, 320, 340, 342, 345; 249/56

[56] References Cited

U.S. PATENT DOCUMENTS

| | | | |
|---|---|---|---|
| 5,143,141 | 9/1992 | Frulla | 164/320 X |
| 5,311,918 | 5/1994 | Scott | 249/56 X |
| 5,427,171 | 6/1995 | Prieto . | |
| 5,538,329 | 7/1996 | Stach . | |
| 5,562,147 | 10/1996 | Bortoloni | 164/120 X |
| 5,626,182 | 5/1997 | Bortoloni | 164/340 |

FOREIGN PATENT DOCUMENTS

| | | |
|---|---|---|
| 5-278401 | 10/1993 | Japan . |

*Primary Examiner*—J. Reed Batten, Jr.
*Attorney, Agent, or Firm*—Cushman Darby & Cushman Intellectual Property Group of Pillsbury Madison & Sutro, LLP

[57] ABSTRACT

A light-alloy wheel is cast using an apparatus wherein cores are moved by a cotter via a sliding mechanism. A sliding portion is isolated from molten metal so that locking at the sliding portion is unlikely to occur. The sliding mechanism can be of a small size and is disposed in an interior of a mold top segment with a relatively large gap between the cotter and the mold top segment. The gap assures a good heat dissipation from the mold top segment. In a molding method conducted using the apparatus, the cores may be positioned at a retracted position and extended before the molten metal has solidified to thereby remove blow holes in a cast wheel.

10 Claims, 7 Drawing Sheets

METHOD AND APPARATUS FOR MOLDING A LIGHT-ALLOY WHEEL

BACKGROUND OF THE INVENTION

1. Field of the Invention

The present invention relates to a method and apparatus for molding a light-alloy wheel, for example an aluminum or aluminum-based alloy wheel (hereinafter, aluminum wheel).

2. Description of Related Art

Conventionally, a light-alloy wheel is cast using a mold so that the cast product has a thick portion radially inside a rim bead seat on the side close to a disc portion, because the product cannot be removed from a core if the core is arranged at that portion.

However, provision of a thick portion is undesirable from the viewpoint of lightening a vehicle. Various proposals have been made for reducing a thickness of the rim bead seat portion of the cast wheel.

More particularly, Japanese Patent Publication No. HEI 5-278401 discloses a method, wherein as shown in FIG. 8 (a one-piece wheel) and FIG. 9 (a two-piece wheel) a removal core 2 is set at a portion of a mold cavity corresponding to a thick portion of a cast wheel 1 and after a molten metal has solidified the core is removed from the cast product. In the two-piece wheel, after the core 2 is removed, the rim and the disc is friction-welded.

U.S. Pat. No. 5,427,171 discloses another method, wherein as shown in FIG. 10 lightener pocket cores 4 are mounted to a mold top segment 3 so as to be movable to and from a thick portion of a cast wheel. The cores 4 are moved by a drive mechanism having a sliding portion 5 which is exposed to a mold cavity 6. The cores 4 are extended into the thick portion of the mold cavity before molten metal is supplied to the mold cavity. After the molten metal has solidified, the cores 4 are retracted from the thick portion of the cast wheel, and then the cast product is removed from the mold.

However, the conventional methods have the following problems:

With the method of Japanese Patent Publication No. HEI 5-278401, because steps of collapsing the cores and removing the cores are needed in addition to usual molding steps, the number of steps and the molding time period are increased, accompanied by an increase in the molding cost. Further, in the two-piece wheel, the friction-welding is further needed.

With the mold of U.S. Pat. No. 5,427,171, because the sliding portion 5 contacts the mold cavity, the molten metal enters a clearance between sliding surfaces of the sliding portion and solidifies to deteriorate the slidability at the sliding portion. If the clearance between the sliding surfaces is made as small as possible for preventing the molten metal from entering the clearance, the core will be locked when the core is thermally expanded.

U.S. Pat. No. 5,427,171 also discloses an example wherein a mechanism for driving the core is constructed of a link mechanism, and the link mechanism is located in a spacial interior defined by an upper surface of the mold top segment so that the link mechanism is isolated from the molten metal. However, such link mechanism inevitably becomes a complicated and a large-sized mechanism. Due to the large size of the mechanism, a space used for heat dissipation is restricted, so that a molten metal cooling by the top mold segment decreases to cause mold defects. Due to the large size of the mechanism, the thickness of a wall of the mold top segment will be decreased, reducing the strength thereof. Further, due to the complexity of the mechanism, the mechanism tends to cause locking especially when the mechanism is heated.

Further, since in the method of Japanese Patent Publication No. HEI 5-278401 and in the method of U.S. Pat. No. 5,427,171 the core is set or fully extended into the thick portion before the molten metal is supplied, an effect of pushing the molten metal by the core to remove blow hole defects in a wall of the cast wheel cannot be expected.

SUMMARY OF THE INVENTION

An object of the present invention is to provide a method and apparatus for molding a light-alloy wheel, capable of ① molding a light-alloy wheel having a reduced thickness at a portion corresponding to a thick portion of the conventional cast wheel and ② preventing molten metal entering a clearance of a sliding mechanism and keeping heat dissipation from the mold top segment good.

Another object of the present invention is to provide a method for molding a light-alloy wheel further capable of ③ decreasing blow hole defects which may be caused in a disc-side rim bead seat portion during molding.

The above-described objects can be achieved by the following method and apparatus according to the present invention.

(1) A mold apparatus according to the present invention for molding a light-alloy wheel includes a mold top segment, a mold bottom segment, at least two mold side segments, a plurality of lightener pocket cores, a plurality of holders, and a cotter.

The mold segments define a mold cavity therebetween. The mold top segment has a concave upper surface defining a spacial interior and a plurality of holes formed therein.

The cores each extends through a respective hole formed in the mold top segment. Each of the cores includes a first end and an opposite, second end. The first end is movable between an extended position corresponding to a thick portion of a cast wheel and a retracted position corresponding to a position in the respective hole formed in the top mold segment. The second end is movable in the spacial interior defined by the concave upper surface of the mold top segment.

Each of the holders holds the second end of the core. The cotter is located in the spacial interior defined by the concave upper surface of the mold top segment. The cotter includes a slidably engaging portion which is isolated from a molten light-alloy and at which the cotter slidably engages the holder. The cotter is movable relative to the mold top segment and moves the cores via the holders.

(2) A method according to a first embodiment of the present invention for molding a light-alloy wheel is conducted using the above-described mold apparatus.

The method includes the steps of: closing the mold segments to form a wheel mold cavity therebetween, keeping the first end of each of the cores at the extended position; supplying molten light-alloy metal into the wheel mold cavity to allow the supplied molten light-alloy metal to solidify; moving the cotter to thereby move each of the cores relative to the mold top segment so that the first end of each of the cores is retracted to the full-retracted position after the supplied molten light-alloy metal has solidified; and opening the mold segments and taking out a cast wheel from the mold segments.

(3) A method according to a second embodiment of the present invention for molding a light-alloy wheel is conducted using the above-described mold apparatus.

The method includes the steps of: closing the mold segments to form a wheel mold cavity therebetween, keeping the first end of each of the cores at a position retracted from the extended position toward the full-retracted position; supplying molten light-alloy metal into the wheel mold cavity to allow the supplied molten light-alloy metal to partially-solidify; moving the cotter to thereby move each of the cores relative to the mold top segment so that the first end of each of the cores is fully protruded to the extended position and pushes the partially-solidified metal positioned in the thick portion of the cast wheel; moving the cotter to thereby move each of the cores relative to the mold top segment so that the first end of each of the cores is retracted to the full-retracted position after the supplied molten light-alloy metal has solidified; and opening the mold segments and taking out a cast wheel from the mold segments.

In the above-described apparatus (1) and method (2), by moving the cores to the retracted position after the molten metal has solidified, the cast wheel can be taken out from the mold segments, without being accompanied by steps of collapsing and removing the core, and therefore without being accompanied by an increase in the number of molding steps and molding cost. Further, since the sliding portion between the core and holder assembly and the cotter is isolated from the molten metal, the molten metal does not enter the sliding portion to cause locking thereof. As a result, the slide mechanism and the drive mechanism therefor are small in size, so that the small sized mechanisms can be set in the spacial interior of the mold top segment without deteriorating the heat dissipation characteristic of the mold top segment. Further, since the core drive mechanism is simple, locking due to a thermal expansion does not occur.

In the above-described method (3), in addition to the above effect according to the method (2), since the cores are protruded from a full-retracted position or a half-retracted position to the full-extended position before the molten metal has completely solidified, the cores pushes the partially-solidified metal to remove blow holes in the partially-solidified metal to improve quality of the cast product.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENT

Figure 1:
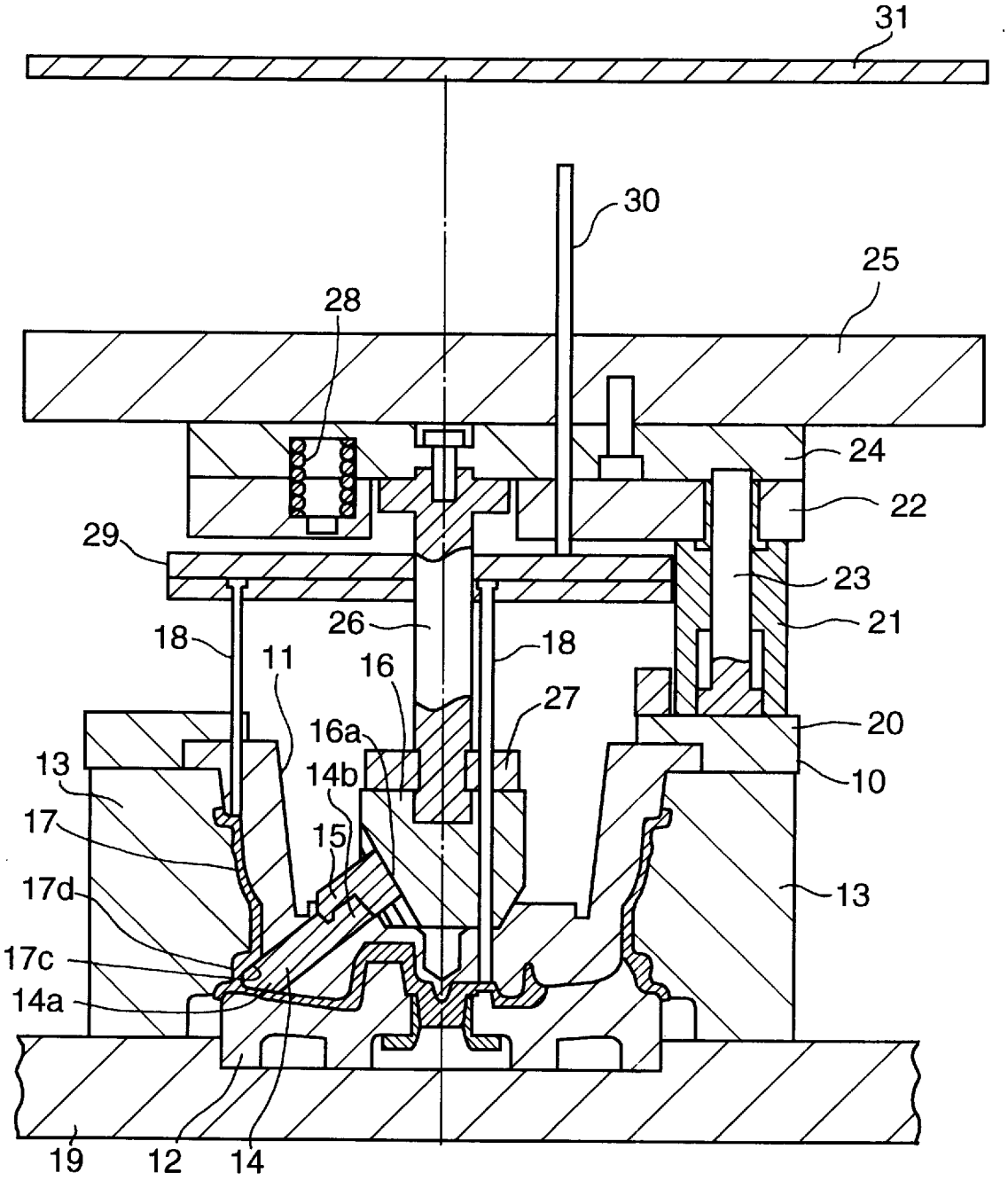
FIG. 1 is a cross-sectional view of a mold apparatus for conducting a method for molding a light-alloy wheel according to a first embodiment of the present invention, in a state where cores are protruded from a mold top segment and molten metal is supplied.
Figure 2:
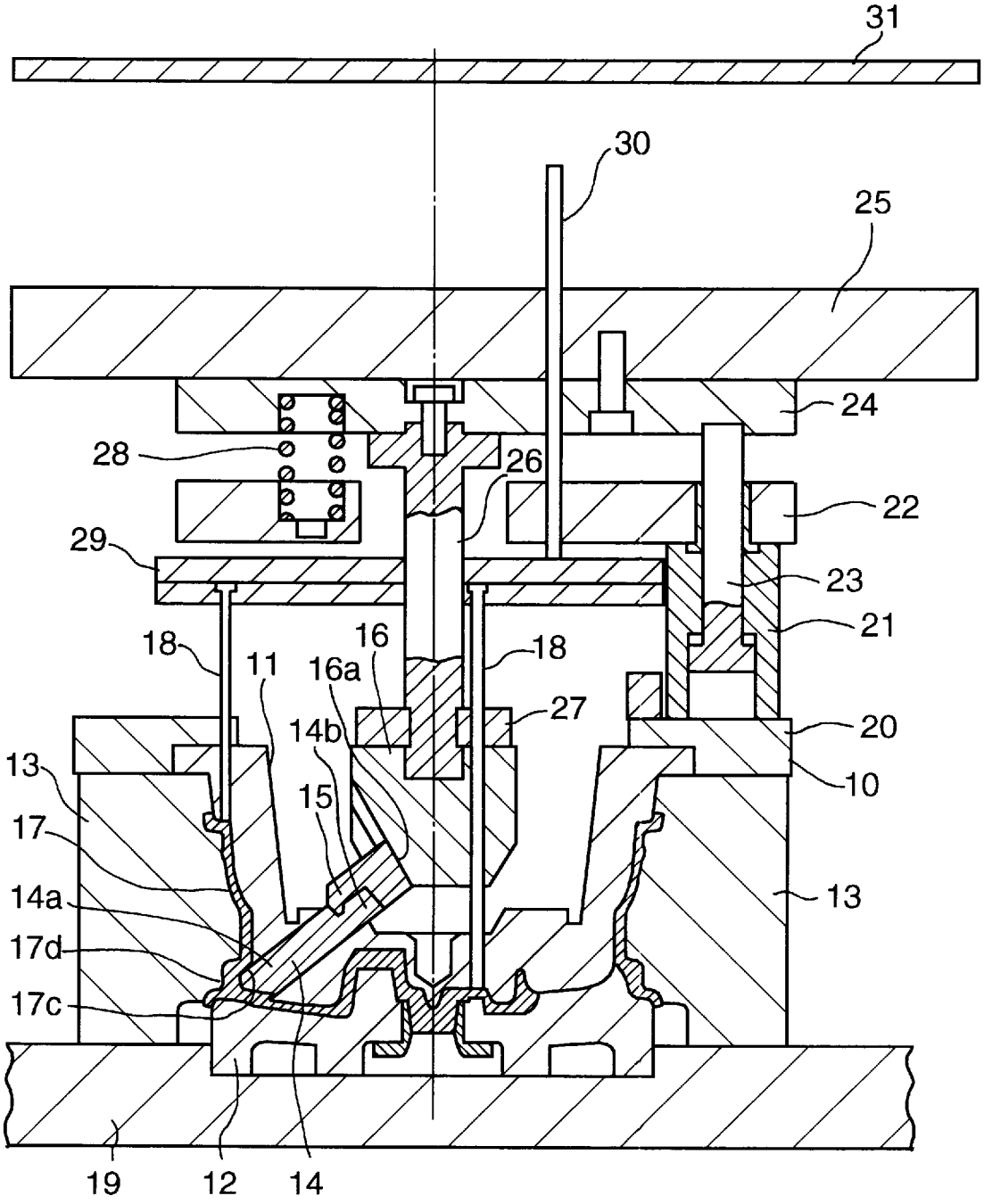
FIG. 2 is a cross-sectional view of a mold apparatus for conducting a method for molding a light-alloy wheel according to a second embodiment of the present invention, in a state where cores are half-protruded from the mold top segment and molten metal is supplied.
Figure 3:
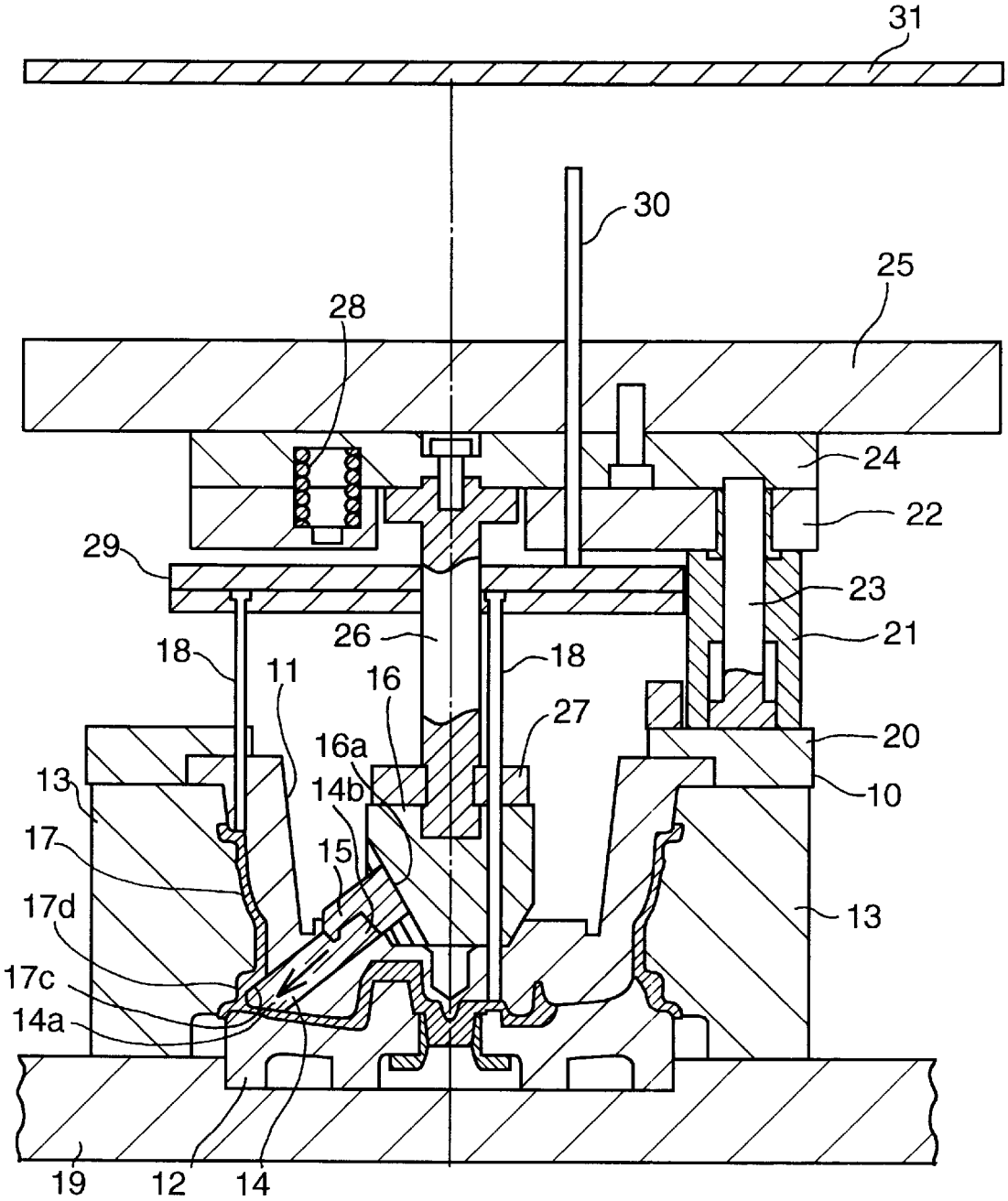
FIG. 3 is a cross-sectional view of the mold apparatus for conducting a method for molding a light-alloy wheel according to the second embodiment of the present invention, in a state where the cores are full-protruded from the mold top segment to push the metal before the metal has been completely solidified.

A mold apparatus for molding ea light-alloy wheel (for example, an aluminum wheel) will be explained with reference to FIGS. 1–7.

The mold apparatus 10 includes a mold top segment 11, a mold bottom segment 12, at least two side segments 13, a plurality of lightener pocket cores 14, a holder 15, and a cotter 16.

The mold apparatus 10 further includes a stationary platen 19, a top plate 20, a support block 21, a top plate holder 22, a support pin 23, a clamp plate 24, a movable platen 25, a cotter holder 26, a cotter joint 27, an ejector pin 18, an ejector plate 29, an ejector pin 30, and an engagement plate 31, the function of which will become apparent below. The mold apparatus 10 may further include a spring 28.

A light-alloy metal 17 supplied into the mold apparatus 10 solidifies to be a cast product (therefore, the cast product is denoted with the same reference number 17). Supply of the light-alloy metal may be conducted at a low pressure or at a high pressure.

The mold top segment 11 has a configuration which enables removing the mold top segment 11 upwardly from the cast wheel product, that is, a configuration having no radial protrusion into a thick portion of the cast wheel.

The mold top segment 11 has a generally concave upper surface defining a spacial interior therein which is open upwardly. In the interior, the cotter 16, the holder 15, and an end portion of each core 14 are disposed. Since the cotter 16, the holder 15, and the end portion of the core 14 have relatively simple structures, respectively, and are of relatively small sizes, the cotter 16 can be movably disposed in the interior of the mold top segment with a thickness of the mold top segment 11 kept relatively large and with a relatively large gap kept between a side surface of the cotter 16 and an inside surface of the mold top segment 11. The relatively large gap keeps heat dissipation from the mold top segment 11 good. The mold top segment 11 includes a plurality of holes formed therein for letting the cores 14 extend therethrough.

The mold top segment 11, the mold bottom segment 12, and the mold side segments 13 sectioned from each other in a circumferential direction of the mold apparatus 10 forms a mold cavity (a cavity to which the molten metal 17 is supplied) therebetween, when the mold segments 11, 12, and 13 are closed.

Each of the lightener pocket cores 14 is set at a portion of the mold cavity corresponding to between adjacent ribs (17*b* in FIG. 7) of a back surface of a disc portion of the wheel. The core 14 is made from metal, for example, steel. Each core 14 obliquely extends through the mold top segment 11 at the hole formed in the mold top segment. Each core 14 is inclined from a vertical axis of the wheel (i.e., a vertical axis of the mold apparatus) by an angle greater than 0°, for example, at 45°.

Figure 5:
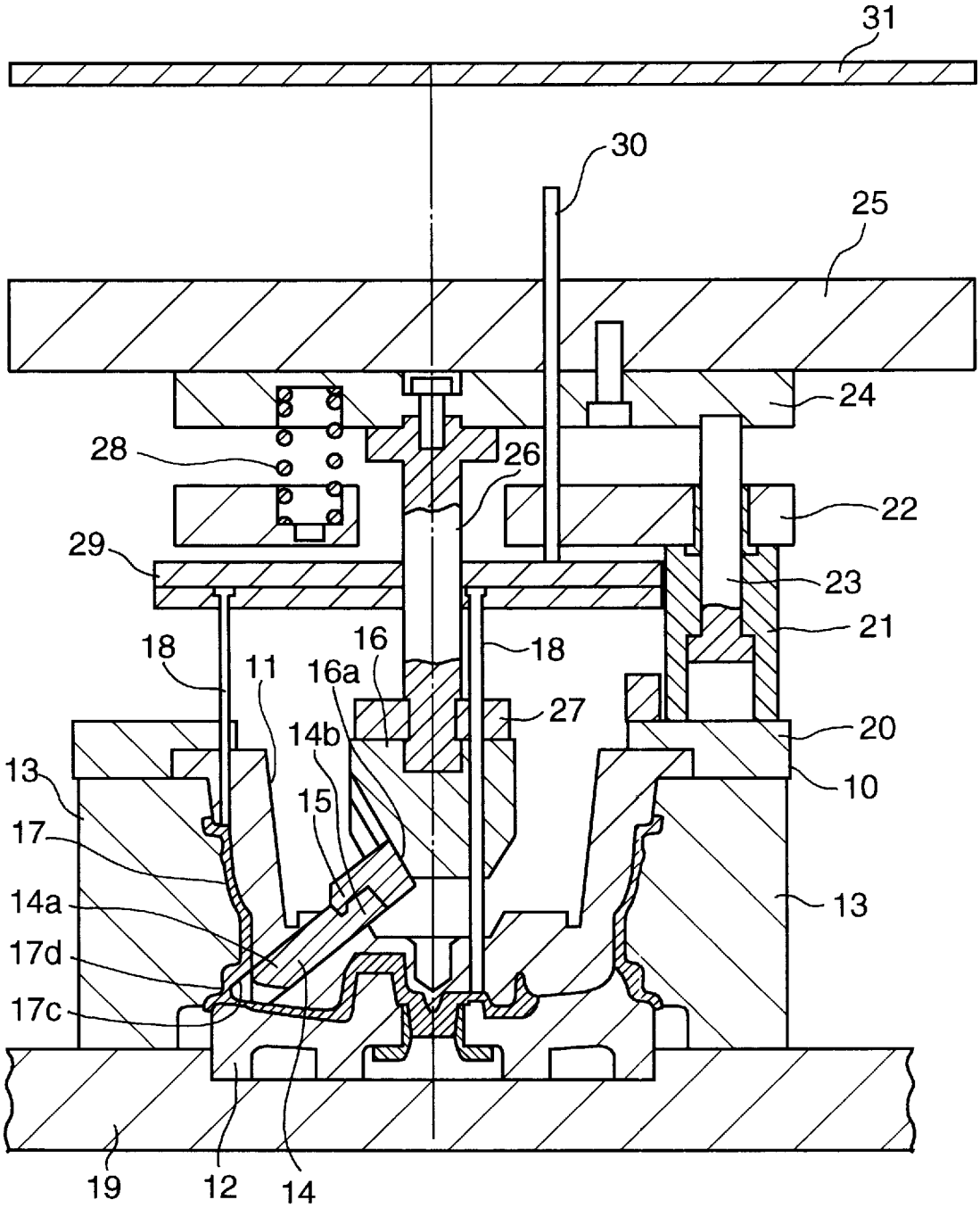
FIG. 5 is a cross-sectional view of the mold apparatus for conducting the methods according to the first and second embodiments of the present invention, in a state where the cores are full-retracted into the mold top segment after the metal is supplied.
Figure 6:
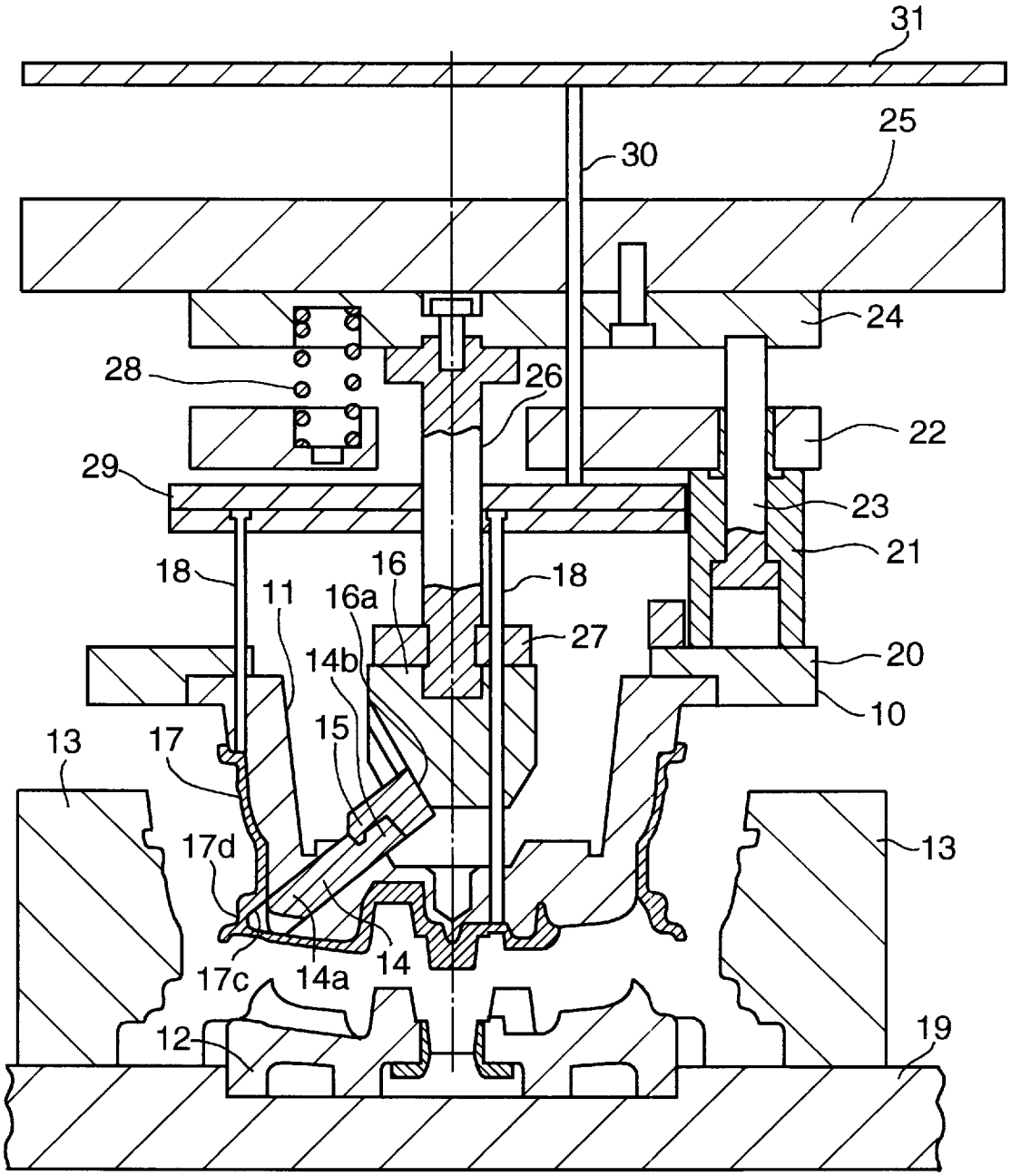
FIG. 6 is a cross-sectional view of the mold apparatus-for conducting the methods according to the first and second embodiments of the present invention, in a state where the mold segments are open.
Figure 7:
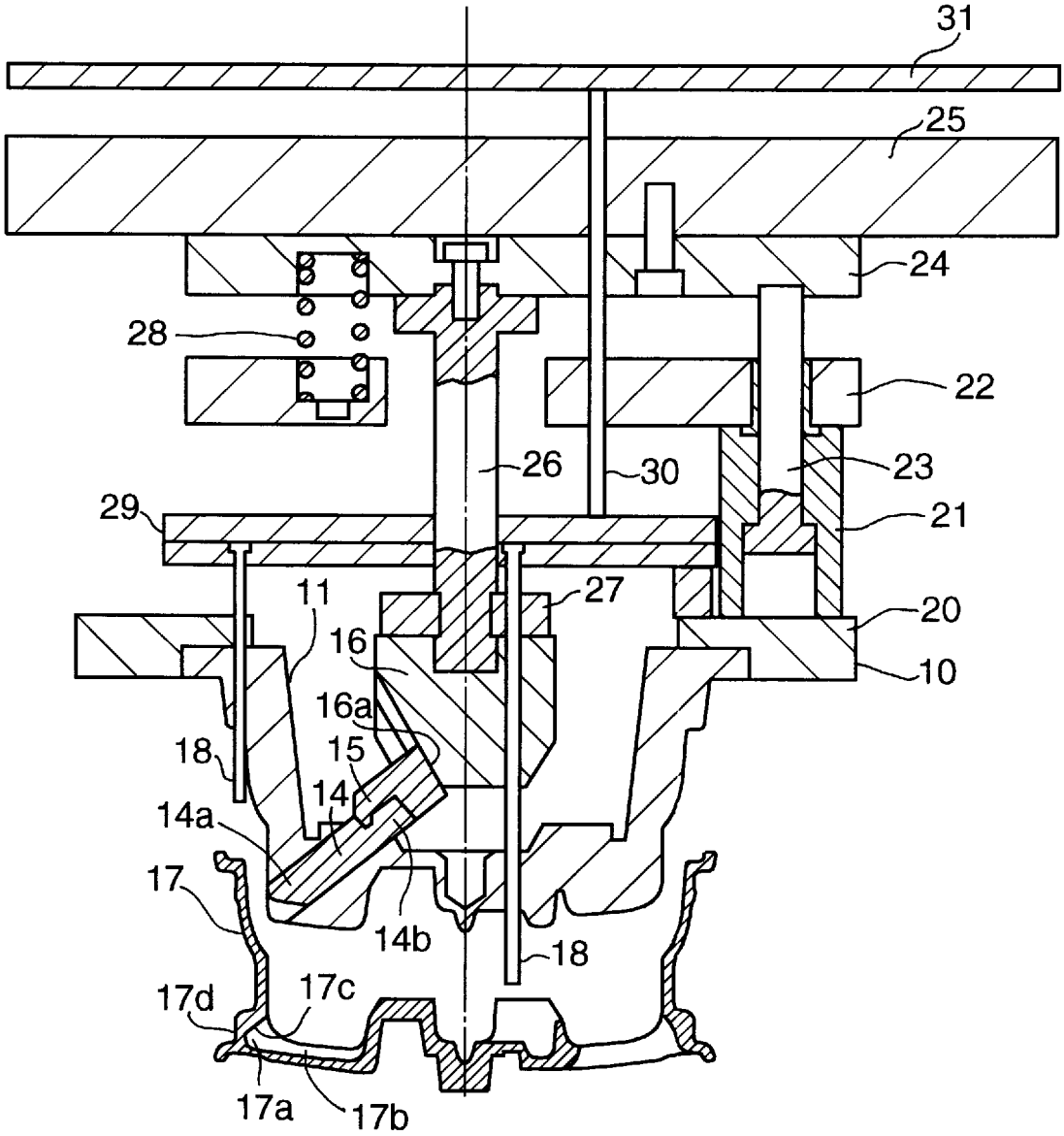
FIG. 7 is a cross-sectional view of the mold apparatus for conducting the methods according to the first and second embodiments of the present invention, in a state where a cast product is taken out from the mold segments.
Figure 8:
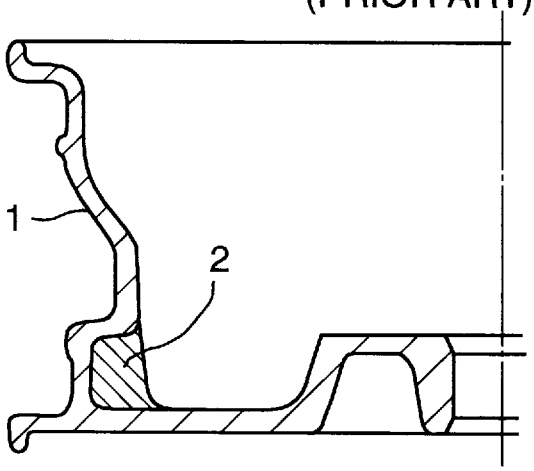
FIG. 8 (PRIOR ART)
FIG. 8 is a cross-sectional view of a half portion of a one-piece wheel cast using a removable core.
Figure 9:
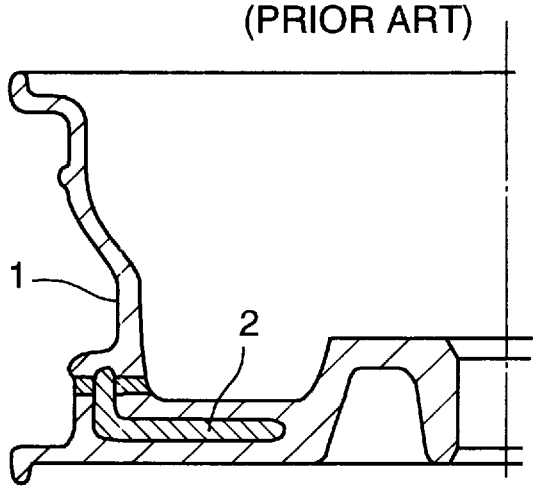
FIG. 9 (PRIOR ART)
FIG. 9 is a cross-sectional view of a half portion of a two-piece wheel cast using a removable core.
Figure 10:
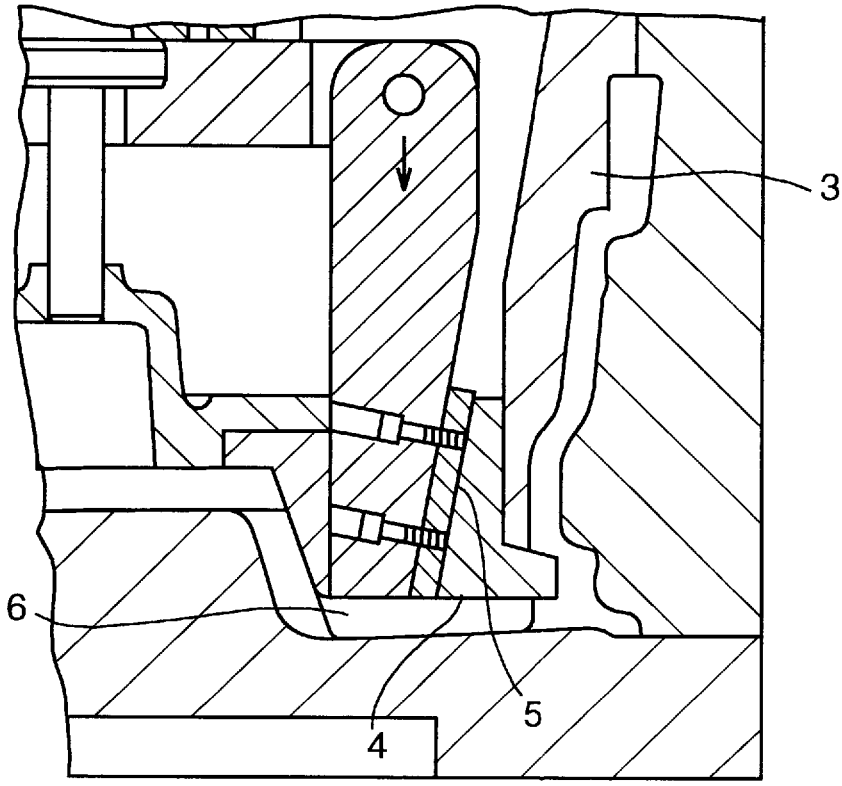
FIG. 10 (PRIOR ART)
FIG. 10 is a cross-sectional view of a conventional mold apparatus having a sliding portion which contacts molten metal.

The core 14 has a first, tip end 14*a* and a second, opposite end 14*b*. Each core 14 is movable relative to the mold top segment 11 in the core inclination direction. The first end 14*a* is movable between an extended position corresponding to a thick portion (17*a* in FIG. 7) of the cast wheel radially inside of the rim bead seat portion and a retracted position corresponding to a position in a respective hole formed in the mold top segment. FIG. 1 shows that the first end 14*a* is positioned at the extended position, and FIG. 5 shows that the first end 14*a* is positioned at the retracted position. The first end 14*a* can stop and maintain stopping at any intermediate position between the extended position and the retracted position. Such intermediate position may be called a half-retracted position or half-protruding position hereinafter, while the retracted position may be called a full-retracted position. The second end 14*b* is movable in the spacial interior defined by the concave upper surface of the mold top segment 11.

Because the core 14 is moved in the core inclination direction, a surface 17*c* of a side wall of the wheel opposing the disc portion extends in the same direction as the core inclination direction, so that a thickness of the side wall of the cast wheel is gradually thickened toward the rim bead seat 17*d*.

The holder 15 is provided to each of the cores 14 and holds the second end 14*b* of each core 14. The holder 15 is movable together with and in the same direction as the core which the holder 15 is coupled to. The holder 15 may be constructed integrally with the core 14, and in the case of integral construction, the holder 15 should be understood to be a holder portion of the integral structure of the core and the holder.

Figure 4:
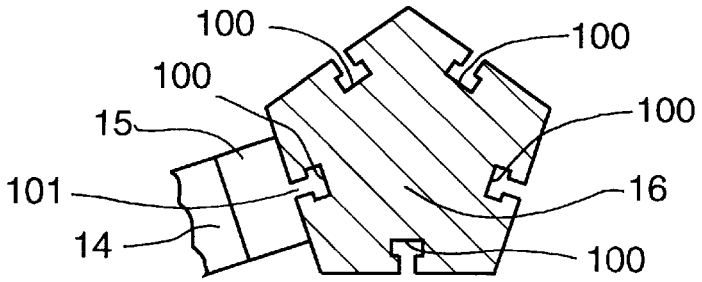
FIG. 4 is a transverse cross-sectional view of a cotter of the mold apparatus.

The cotter 16 is a single member, and is slidable with (i.e., slidably engages or contacts) the holder 15 (or the holder portion of the core in the case of the integral structure of the core and the holder) at a sliding portion 16*a*. The sliding portion 16*a* is positioned at the spacial interior defined by the concave upper surface of the mold top segment 11, and is isolated and spaced from the molten metal in the mold cavity so that the sliding portion 16*a* does not contact the molten metal. As illustrated in FIG. 4, the cotter 16 has a transverse cross-section of the shape of a polygon, for example, a pentagon. In each side of the polygon, a groove 100 having a transverse cross-section of the shape of the letter T is formed. The holder 15 (or the holder portion of the core in the case of the integral structure of the core and the holder) has a protrusion 101 having a transverse cross-section of the shape of the letter T. The protrusion 101 and the groove 100 slidably engage each other and construct the sliding portion 16*a*.

The sliding portion 16*a* extends in a direction substantially perpendicular to the core extending direction (i.e., the core inclination direction). The cotter 16 is movable in the vertical direction along a vertical axis of the mold top segment 11 relative to the mold top segment 11. When the cotter 16 is moved relative to the mold top segment 11, the cotter 16 moves the plurality of cores 14 via the holder 15 (or directly in the case of the integral structure of the core and the holder) in the core extending direction. When the cotter 16 is moved upwardly, the cores 14 are moved so that the first ends 14*a* are retracted to the position in the holes formed in the mold top segment 11, and when the cotter 16 is moved downwardly, the cores 14 are moved so that the first ends 14*a* are moved to the extended position.

The mold bottom segment 12 is fixedly coupled to the stationary platen 19. The movable platen 25 is moved vertically above the stationary platen 19 and moves the mold top segment 11 and the cotter 16 vertically.

The mold top segment 11 is fixedly coupled to the top plate 20 so that the top plate 20 is moved together with the mold top segment 11. The top plate 20 is held by the top plate holder 22 via the support block 21. The top plate 20, the support block 21, and the top plate holder 22 are suspended by the clamp plate 24 via the support pin 23. The support pin 23 is slidable with the top plate holder 22. The clamp plate 24 is fixedly coupled to the movable platen 25 by means such as bolts.

The cotter 16 is fixedly coupled to the cotter holder 26 by the cotter joint 27. The cotter holder 26 is fixedly coupled to the clamp plate 24 by means such as bolts.

The ejector pin 18 extends downwardly through the mold top segment 11 to the mold cavity, and ejects the cast product (the cast wheel) out from the mold top segment 11 when the mold top segment 11 is moved upwardly. The ejector pin 18 is held by the ejector plate 29. Another ejector pin 30 extends upwardly from the ejector plate 29. When a top end of the ejector pin 30 comes into contact with the stationary engagement plate 31, the ejecting force acts on the cast wheel to eject the cast wheel out from the mold top segment 11.

Between the top plate holder 22 and the clamp plate 24, the spring 28 may be disposed for moving the cores 14 relative to the mold top segment 11. In a case where the core 14 can slide with respect to the mold top segment 11 by selfweight, the spring 28 does not need to be provided.

A method for molding a light-alloy wheel conducted using the above-described apparatus will now be explained with reference to FIGS. 1–3, and 5–7.

A method according to the first embodiment of the present invention includes the steps of: ① closing the mold top segment 11, the mold bottom segment 12 and the mold side segments 13 to form a wheel mold cavity therebetween, keeping the first end 14*a* of each of the cores 14 at the extended position; ② supplying molten light-alloy metal into the wheel mold cavity to allow the supplied molten light-alloy metal to solidify; ③ moving the cotter 16 to thereby move each of the cores 14 relative to the mold top segment 11 so that the first end 14*a* of each of the cores 14 is retracted to the full-retracted position after the supplied molten light-alloy metal has solidified; and ④ opening the mold top segment 11, the mold bottom segment 12 and the mold side segments 13 and taking out a cast wheel 17 from the mold top segment 11, the mold bottom segment 12 and the mold side segments 13. When taking out the cast wheel 17, the ejector pin 18 may be used to eject the cast wheel 17 from the mold top segment 11. The step ① corresponds to a stage of FIG. 1 before the molten metal is supplied, the step ② corresponds to a stage of FIG. 1 after the molten metal has been supplied, the step ③ corresponds to a stage of FIG. 5, and the step ④ corresponds to a stage of FIG. 6 or stages of FIGS. 6 and 7.

The constructed cast wheel 17 has a reduced thickness at a portion corresponding to the thick portion 17*a* of the cast wheel except the ribs 17*b*. Since the conventional removable core is not used, steps of destroying and removing a core do not need to be provided. Therefore, lightening the cast wheel can be achieved without being accompanied by an increase in the number of molding steps and in cost. Further, the cores 14 are made from metal, repeating use of the cores 14 is possible.

Since mechanism for moving the cores 14 to protrude from and to retract in the mold top segment 11 does not include a link mechanism and a gear engaging mechanism, the mold apparatus 10 is unlikely to cause locking in operation.

Since the sliding portion 16*a* is isolated from the molten metal, slidability of the holder 15 with the cotter 16 is maintained. Further, since the sliding portion 16*a* is spaced and isolated from the mold cavity, the temperature of the sliding portion 16*a* is kept relatively low. As a result, locking due to the difference in thermal expansion between the sliding members is unlikely to occur. Therefore, it is not necessary to use a force amplifying mechanism such as a link mechanism and a toggle mechanism to move the cores, and the mechanism is simple and of a small size. As a result, the holder 15, the cotter 16, and the sliding portion 16*a* can be disposed in the limited space of the interior defined by the concave upper surface of the mold top segment 11, and heat dissipation from the top mold segment 11 is kept good.

A method according to the second embodiment of the present invention includes the steps of: ① closing the mold top segment 11, the mold bottom segment 12 and the mold side segments 13 to form a wheel mold cavity therebetween, keeping the first end 14*a* of each the cores 14 at a position retracted (half-retracted or full-retracted) from the extended position toward the full-retracted position; ② supplying molten light-alloy metal into the wheel mold cavity to allow the supplied molten light-alloy metal to partially-solidify; ③ moving the cotter 16 to thereby move each of the cores 14 relative to the mold top segment 11 so that the first end 14*a* of each of the cores 14 is fully protruded to the extended position and pushes the partially-solidified metal positioned in the thick portion 17*a* of the cast wheel 17; (A moving the cotter 16 to thereby move each of the cores 14 relative to the mold top segment 11 so that the first end 14*a* of each of the cores 14 is retracted to the full-retracted position after the supplied molten light-alloy metal has solidified; and ⑤ opening the mold top segment 11, the mold bottom segment 12 and the mold side segments 13 and taking a cast wheel 17 out from the mold top segment 11, the mold bottom segment 12 and the mold side segments 13. When taking out the cast wheel 17, the ejector pin 18 may be used to eject the cast wheel 17 from the mold top segment 11. The step ① corresponds to a stage of FIG. 5 (in the case where the core is at a full-retracted position) or FIG. 2 (in the case where the core is at a half-retracted position) before the molten metal is supplied, the step ② corresponds to a stage of FIG. 5 (in the case where the core is at a full-retracted position )or FIG. 2 (in the case where the core is at a half-retracted position after the molten metal has been supplied, the step ③ corresponds to a stage of FIG. 3, the step ④ corresponds to a stage of FIG. 5 and the step ⑤ corresponds to a stage of FIGS. 6 and 7.

A relationship between a solidified state of the molten metal and an elapsed time since the beginning of supply of the molten metal is determined based on tests before molding. Timing of start of pushing the partially-solidified molten metal by the cores 14 is determined on the relationship predetermined based on the tests and is managed based on a time elapsed since the start of supplying the molten metal.

Pushing the partially-solidified metal positioned at the thick portion 17*a* of the cast wheel by the cores 14 is conducted while a solid phase rate (a rate of a solid phase portion to a summation of a solid phase portion and a liquid phase portion) of the partially-solidified metal is at 0.2–0.8. The reason is that if at lower than 0.2, the molten metal is too aqueous to be squeezed, and if at higher than 0.8, the molten metal is too rigid to be pushed. Especially, pushing at 0.5–0.7 is more preferable.

In the method according to the second embodiment of the present invention, since the molten metal positioned at the thick portion 17*a* of the case wheel 17 is pushed by the cores 14, generation of blow holes in that portion 17*a* is suppressed. Further, the metal at the thick portion 17*a* is squeezed to be fine in metal matrix. As a result, a fatigue strength of that portion and the life of the wheel are increased.

Other effects of the method according to the second embodiment of the present invention is the same as those of the method according to the first embodiment above discussed.

According to the present invention, the following technical,advantages are obtained:

First, with the apparatus according to the present invention, since the cores 14 are movable between the extended position and the retracted position, the cast wheel 17 can be taken out from the mold segments after the molten metal has solidified by positioning the cores 14 at the retracted position, without destroying and removing the cores. As a result, lightening the cast wheel 17 can be achieved without being accompanied by an increase in the number of steps for molding the cast wheel and a cost.

Second, with the apparatus according to the present invention, since the sliding portion 16*a* between the holder and the cotter 16 is isolated from the molten metal, locking at the sliding portion 16*a* due to entering of the molten metal into a clearance of the sliding portion is prevented. Therefore, the mechanism for extending and retracting the cores 14 can be operated at a relatively small force and can be a sliding mechanism of a simple structure and of a small size. As a result, the mechanism can be disposed in the spacial interior defined by a concave upper surface of the mold top segment 11 with a relatively large gap between the cotter 16 and the mold top segment 11, which assures a good heat dissipation from the mold top segment 11 and improves the cast quality as well as shortens the cast cycle time period.

Third, with the method according to the first embodiment of the present invention, the same advantages as described above with the apparatus are obtained.

Fourth, with the method according to the second embodiment of the present invention, the same advantages as described above with the apparatus are obtained. In addition, since the partially-solidified metal is pushed by the cores 14, the blow holes are removed and the metal matrix is made fine. As a result, the quality of the cast wheel is improved, especially at the rim bead seat which repeatedly receives loads from a tire, and the fatigue strength and life of the wheel is improved.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A method for molding a light-alloy wheel, conducted using a mold apparatus including a mold top segment, a mold bottom segment, at least two side segments, a plurality of lightener pocket cores, and a cotter, said mold top segment having a generally concave upper surface defining a spacial interior therein and a plurality of holes formed therein, each of said cores being slidable relative to said mold top segment at a respective one of said holes and having a first end and a second end, said first end being movable between an extended position corresponding to a thick portion of a cast wheel and a full-retracted position in a respective one of said holes, said second end being movable in said spacial interior so as not to contact a molten light-alloy metal, said cotter slidably engaging said second end of each of said cores via a holder so that said second end moves between said extended position and said retracted position when said cotter is moved, said method comprising the steps of:

closing said mold top segment, said mold bottom segment and said mold side segments to form a wheel mold cavity therebetween, keeping said first end of each of said cores at said extended position;

supplying molten light-alloy metal into said wheel mold cavity to allow said supplied molten light-alloy metal to solidify;

moving said cotter to thereby move each of said cores relative to said mold top segment so that said first end of each of said cores is retracted to said full-retracted position after said supplied molten light-alloy metal has solidified; and opening said mold top segment, said mold bottom segment and said mold side segments and taking a cast wheel out from said mold top segment, said mold bottom segment and said mold side segments.

2. A method for molding a light-alloy wheel, conducted using a mold apparatus including a mold top segment, a mold bottom segment, at least two side segments, a plurality of lightener pocket cores, and a cotter, said mold top segment having a generally concave upper surface defining a spacial interior therein and a plurality of holes formed therein, each of said cores being slidable relative to said mold top segment at a respective one of said holes and having a first end and a second end, said first end being movable between an extended position corresponding to a thick portion of a cast wheel and a full-retracted position in a respective one of said holes, said second end being movable in said spacial interior so as not to contact a molten light-alloy metal, said cotter slidably engaging said second end of each of said cores via a holder so that said second end moves between said extended position and said retracted position when said cotter is moved, said method comprising the steps of:

closing said mold top segment, said mold bottom segment and said mold side segments to form a wheel mold cavity therebetween, keeping said first end of each of said cores at a position retracted from said extended position toward said full-retracted position;

supplying molten light-alloy metal into said wheel mold cavity to allow said supplied molten light-alloy metal to partially-solidify;

moving said cotter to thereby move each of said cores relative to said mold top segment so that said first end of each of said cores is fully protruded to said extended position and pushes the partially-solidified metal positioned in the thick portion of the cast wheel;

moving said cotter to thereby move each of said cores relative to said mold top segment so that said first end of each of said cores is retracted to said full-retracted position after said supplied molten light-alloy metal has fully solidified; and opening said mold top segment, said mold bottom segment and said mold side segments and taking a cast wheel out from said mold top segment, said mold bottom segment and said mold side segments.

3. A method according to claim 2, wherein during said cavity forming step, said first end of each of said cores is kept at a fully retracted position in a respective one of said holes formed in said mold top segment.

4. A method according to claim 2, wherein during said cavity forming step, said first end of each of said cores is kept at an intermediate position between said extended position and said fully-retracted position.

5. A method according to claim 2, wherein pushing the partially-solidified metal positioned in the thick portion of the cast wheel by each of said cores is conducted while a solid phase rate of the partially-solidified metal is at 0.2–0.8.

6. A method according to claim 5, wherein pushing the partially-solidified metal positioned in the thick portion of the cast wheel by each of said cores is conducted while a solid phase rate of the partially-solidified metal is at 0.5–0.7.

7. A mold apparatus for molding a light-alloy wheel comprising:

a mold top segment, a mold bottom segment and at least two mold side segments defining a mold cavity therebetween, said mold top segment having a generally concave upper surface defining a spacial interior and a plurality of holes formed therein;

a plurality of lightener pocket cores each extending through a respective one of said holes formed in said mold top segment, each of said lightener cores including a first end and an opposite, second end, said first end being movable between an extended position corresponding to a thick portion of a cast wheel and a retracted position corresponding to a position in a respective said hole formed in said mold top segment, said second end being movable in said spacial interior defined by said generally concave upper surface of said mold top segment;

a plurality of holders each holding said second end of a respective one of said lightener pocket cores; and a cotter located in said spacial interior defined by said generally concave upper surface of said mold top segment, said cotter including a slidably engaging portion which is isolated from a molten light-alloy and at which said cotter slidably engages each of said plurality of holders, said cotter being movable relative to said mold top segment and moving said plurality of lightener pocket cores via said plurality of holders.

8. An apparatus according to claim 7, further comprising:

a stationary platen to which said mold bottom segment is fixedly coupled;

a top plate to which said mold top segment is fixedly coupled, said top plate being moved together with said mold top segment;

a top plate holder holding said top plate via a support block;

a clamp plate suspending said top plate, said support block and said top plate holder via a support pin;

a movable platen to which said clamp plate is fixedly coupled, said movable platen being movable vertically; and a cotter holder coupling said cotter to said clamp plate.

9. An apparatus according to claim 7, wherein said cotter has a transverse cross-section of the shape of a polygon having sides, each of said sides having a groove having a T-shaped transverse cross-section, each of said holders slidably engaging said groove.

10. An apparatus according to claim 9, wherein said polygon is a pentagon.

* * * * *